United States Patent [19]

Glover

[11] 3,936,229

[45] Feb. 3, 1976

[54] LIQUID AGITATOR

[75] Inventor: George E. Glover, Philadelphia, Pa.

[73] Assignee: Crane Co., New York, N.Y.

[22] Filed: May 10, 1973

[21] Appl. No.: 357,401

Related U.S. Application Data

[63] Continuation-in-part of Ser. No. 10,777, Feb. 12, 1970, abandoned.

[52] U.S. Cl. ..... 416/178; 259/108

[51] Int. Cl.² ..... B01F 7/20

[58] Field of Search ..... 416/178, 183, 187, 211; 259/108, 107

[56] References Cited

UNITED STATES PATENTS

| | | | |
|---|---|---|---|
| 84,658 | 12/1868 | Tucker | 416/211 |
| 210,800 | 12/1878 | Nebinger | 416/211 |
| 2,161,631 | 6/1939 | McFarland | 416/200 |
| 3,545,729 | 12/1970 | Wisseroth et al. | 259/107 |

*Primary Examiner*—Everette A. Powell, Jr.

*Attorney, Agent, or Firm*—George S. Schwind

[57] ABSTRACT

The liquid agitator is of the type used in stirring water containing small particles of suspended matter to cause the particles to come together and form agglomerations (e.g., flocs) which will settle faster than the individual small particles. The agitator includes a paddle having pale elements and each of the pale elements has a predetermined shape, size and disposition so that said paddle produces a substantially uniform velocity gradient in the water being agitated when the paddle is rotated. The uniform velocity gradient developed will provide uniform agitation of the water to obtain uniform flocculation throughout the agitated volume even though the linear velocity of various portions of the paddle will be different depending on the radial distance of that portion from the vertical axis. Another embodiment utilizes a second paddle wherein the pale elements project between the pale elements of the first paddle, said second paddle can be stationary or counter rotated with reference to the first paddle.

11 Claims, 4 Drawing Figures

42a
42b
38
65
53
36
43
54
58
40
46
60
4

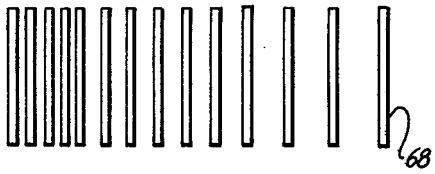
FIG. 6
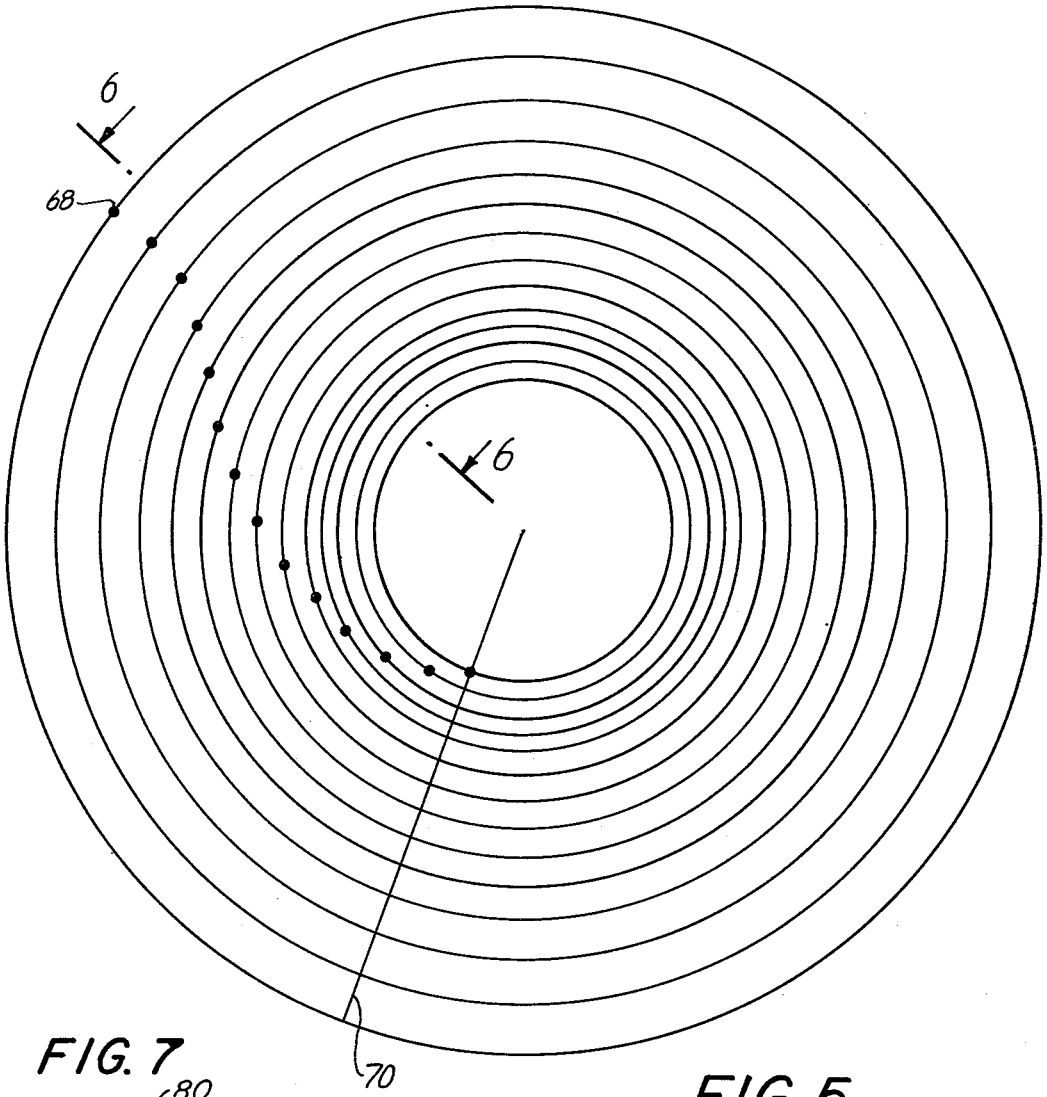
FIG. 5
FIG. 7
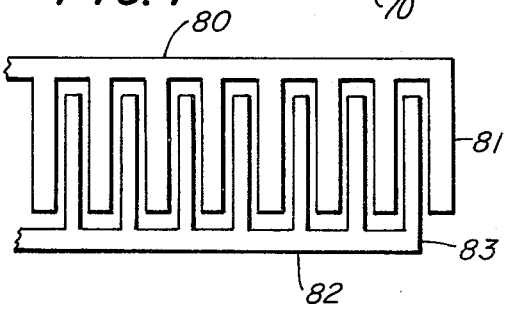

LIQUID AGITATOR

This application is a continuation-in-part of application bearing Ser. No. 10,777 filed Feb. 12, 1970 and now abandoned.

The present invention relates to a liquid agitator particularly for use in water clarification systems for accelerating flocculation of small particles of suspended matter into agglomerations of flocs which will settle faster than the individual small particles from the water. More particularly, the present invention relates to a paddle for a liquid agitator which is designed and constructed so that when the paddle is rotated through a body of liquid the paddle will produce or establish a substantially uniform velocity gradient in the agitated liquid. The velocity gradient is a parameter which has been established as a criterion in the design of liquid agitators or flocculators and is given the symbol G. The velocity gradient is expressed in units of feet per second per foot (sec. $^{-}$) and is equal to the square root of the energy dissipated per unit volume of liquid divided by the absolute viscosity of the liquid at a particular temperature, i.e., $$G = K \frac{Hp}{Vu}$$

where, $Hp$ = Horsepower expended $V$ = Volume of the flocculator chamber;

$u$ = Absolute viscosity for the liquid in the chamber; and $K$ = Constant.

Accordingly, the present invention provides a liquid agitator having paddles which are mounted for rotation about an axis and which produce a uniform velocity gradient throughout a body of liquid being agitated when the paddles are rotated through the liquid. In this way, the kinetic energy dissipated per unit volume of liquid will be the same at any location in the body of liquid being agitated. Stated otherwise, the body of liquid is uniformly agitated. In the ensuing illustrations, rotation about a vertical axis is used as exemplary, although it is evident that rotation about an axis of any orientation is within the scope of this invention.

Heretofore, it has been learned that the extent of flocculation is directly proportional to the product of the velocity gradient in a body of liquid in a flocculating chamber multiplied by the residence time of the liquid in the flocculation chamber. Thus, a high velocity gradient will permit a low residence time to obtain a given amount of flocculation. This means that for a flocculation chamber having a predetermined volume, the liquid flow rate through the chamber can be increased to thereby achieve faster flocculation with the resulting formation of fast settling flocs. On the other hand, it means that a smaller volume flocculation chamber can be utilized for the same liquid flow rate through the chamber.

In the prior art, wherein flocculators having a plurality of paddles of uniform construction mounted for rotation about a central axis within a flocculating chamber, the highest rotational speed allowable is determined by the velocity gradient established near the outer or distal end of the paddle since it moves faster than the inner end of the paddle.

In this respect, it has been found that for a velocity gradient in excess of approximately 70 sec.$^{-1}$ the turbulence produced is violent enough to rupture previously formed agglomerations of floc. Thus, the liquid agitator must be rotated at a rotational speed where the maximum velocity gradient produced near the distal end of the paddle moving through the liquid being agitated is below 70 sec.$^{-1}$. It will be appreciated that other portions of the paddle inwardly of the outer end will produce smaller velocity gradients and such a paddle does not establish a uniform velocity gradient. Therefore, maximum flocculation only will be obtained near the outer end of the paddle.

Accordingly, lack of control of the velocity gradient along the radial length of a paddle rotation through a body of liquid being agitated, has in the past required that the agitator be rotated at a slow speed for a long residence time to avoid producing a velocity gradient at any point in the fluid above 70 sec.$^{-1}$. Moreover, a slow rotational speed required large flocculation equipment to obtain a given amount of flocculation for a given liquid feed through the flocculator.

Therefore, a general object of the present invention is the provision of a liquid agitator having a novel paddle configuration which produces a uniform velocity gradient in a body of liquid having any viscosity when the paddle is rotated at any rotational speed through the liquid.

Another object of the present invention is the provision of a liquid agitator which is used in a flocculator and which has a novel paddle configuration by which the agitator produces a uniform velocity gradient in a body of liquid received in a flocculating chamber so that a higher rotational speed can be used when rotating the agitator to obtain: a lower residence time for the liquid received in the flocculating chamber, the use of a higher liquid flow rate through the chamber, and a high rate of floc settling, thereby providing a more efficient flocculator.

Another object of the present invention is the provision of a flocculator having a rotor element which is mounted for rotation about an axis in the center of a liquid receiving flocculating chamber wherein the liquid in the chamber is agitated uniformly by the rotor element.

Still another object is to provide a liquid agitator having a plurality of paddles which are counter rotated with reference to each other.

Another object of the present invention is the provision of a fluid agitator having one or more paddles mounted for rotation about an axis in a chamber wherein each paddle has a plurality of pale elements which have a predetermined projected area, size, shape and spacing so that rotation of the paddles at predetermined rotational speed through a body of liquid having a predetermined viscosity will produce the desired velocity gradient uniformly in the agitated portion of the body of liquid.

Still another object of the present invention is the provision of a liquid agitator having one or more paddles mounted for rotation about an axis with each paddle having a plurality of pale elements which are nonuniformly spaced and which have a predetermined size and shape, so that the paddle will uniformly agitate a body of liquid through which the paddle is rotated such that the kinetic energy dissipated by the paddles in the liquid will be the same at any point in the body of liquid. It is evident that this object can be accomplished by an agitator paddle having equally spaced, equal sized, and identical cylindrical elements where the paddle is not straight but curved with respect to the radius such that the projected area of elements upon a radius will yield the required non-uniform spacing.

These and other objects and advantages of the present invention, and the manner of their attainment, will become more apparent from the following description of the preferred embodiments of the invention taken in conjunction with the accompanying drawings wherein for purpose of illustration, a cylindrical flocculator mounted within a clarifier will be used. Obviously the teaching of this invention is equally applicable to a flocculator external to a clarifier or where flocculation is desired for reasons other than to produce a fast settling floc for settling in a clarifier for example: to produce a dense floc to increase the capacity of a granular bed filter.

IN THE DRAWINGS

FIG. 5 is a diagrammatic top plan view of a modified paddle construction for use in the flocculator shown in FIG. 2;

FIG. 6 shows the radial spacing that exists between the pale elements of the modified paddle shown in FIG. 5 when these pale elements are laid out on a radius taken along line 6—6 of FIG. 5; and FIG. 7 shows the use of two sets of pale element on different paddles.

Figure 1:
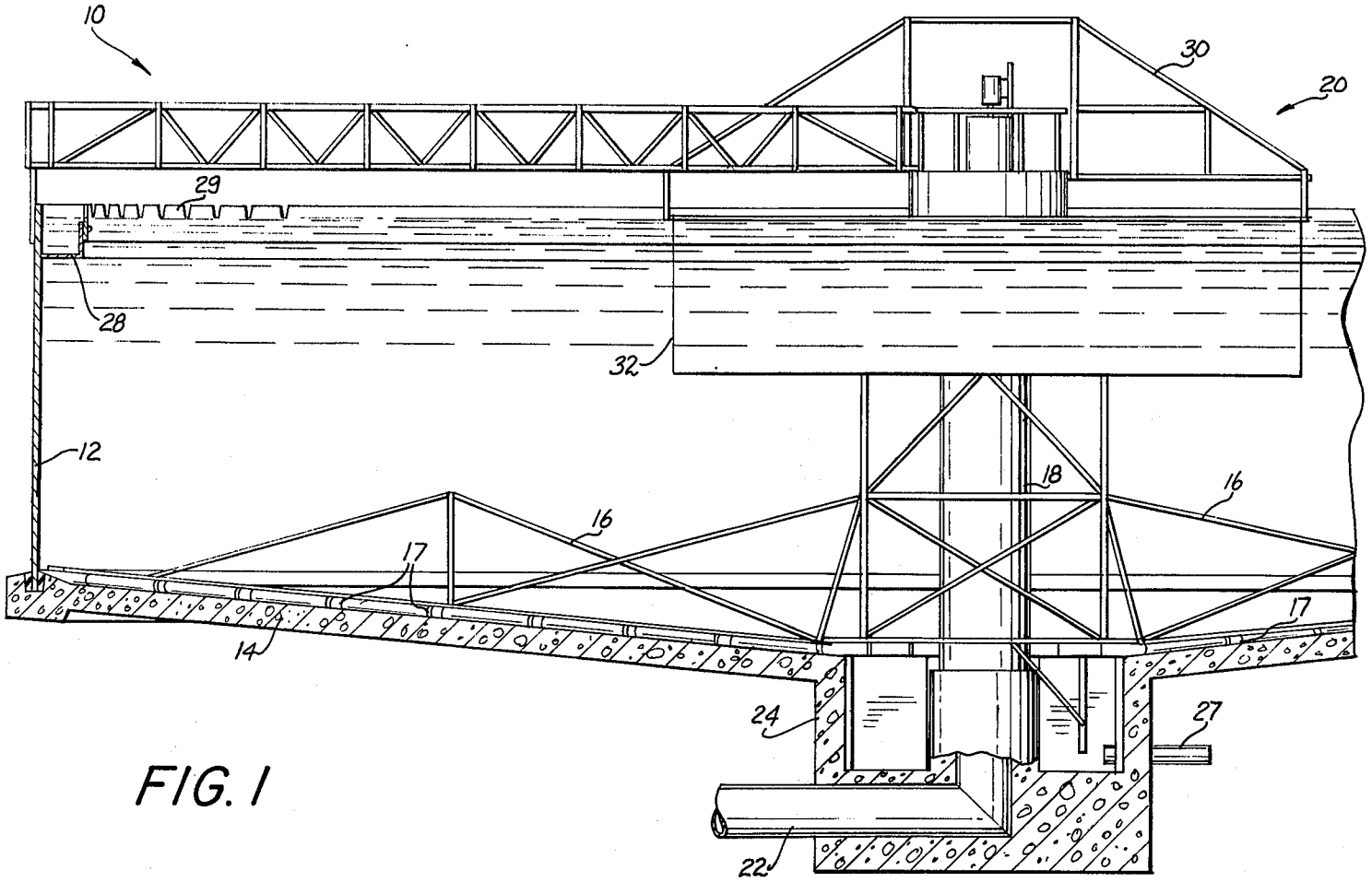
FIG. 1 is a fragmentary vertical sectional view of a water clarifier including a flocculating chamber.

Referring now to the drawings in greater detail, a liquid clarifier is generally indicated at 10 in FIG. 1. The clarifier 10 includes a circular shell 12 which can be made of steel or concrete and which is supported on a dish shaped floor 14 which is normally made of concrete. Two oppositely extending sludge raking arms 16 mounting scrapers 17 are positioned adjacent the floor 14 in a well known manner. The sludge raking arms 16 are supported by a support column 18 which also serves as a water inlet conduit and a flocculator, indicated generally at 20, disposed at the center of the clarifier at the liquid level. A water feed inlet 22 extends through a cylindrical well structure 24 and upwardly through the column 18 for feeding water into the flocculator 20 through port openings 26 (FIG. 2) in the top of the column 18. A sludge outlet 27 extends from the cylindrical well structure 24 for removing sludge which is swept into the cylindrical well structure 24 by the scrapers 17. Also, a peripheral launder 28 is provided at the top of the shell 12 and has a V-notched weir plate 29 to facilitate spillover of the clarified water into the launder 28.

Figure 2:
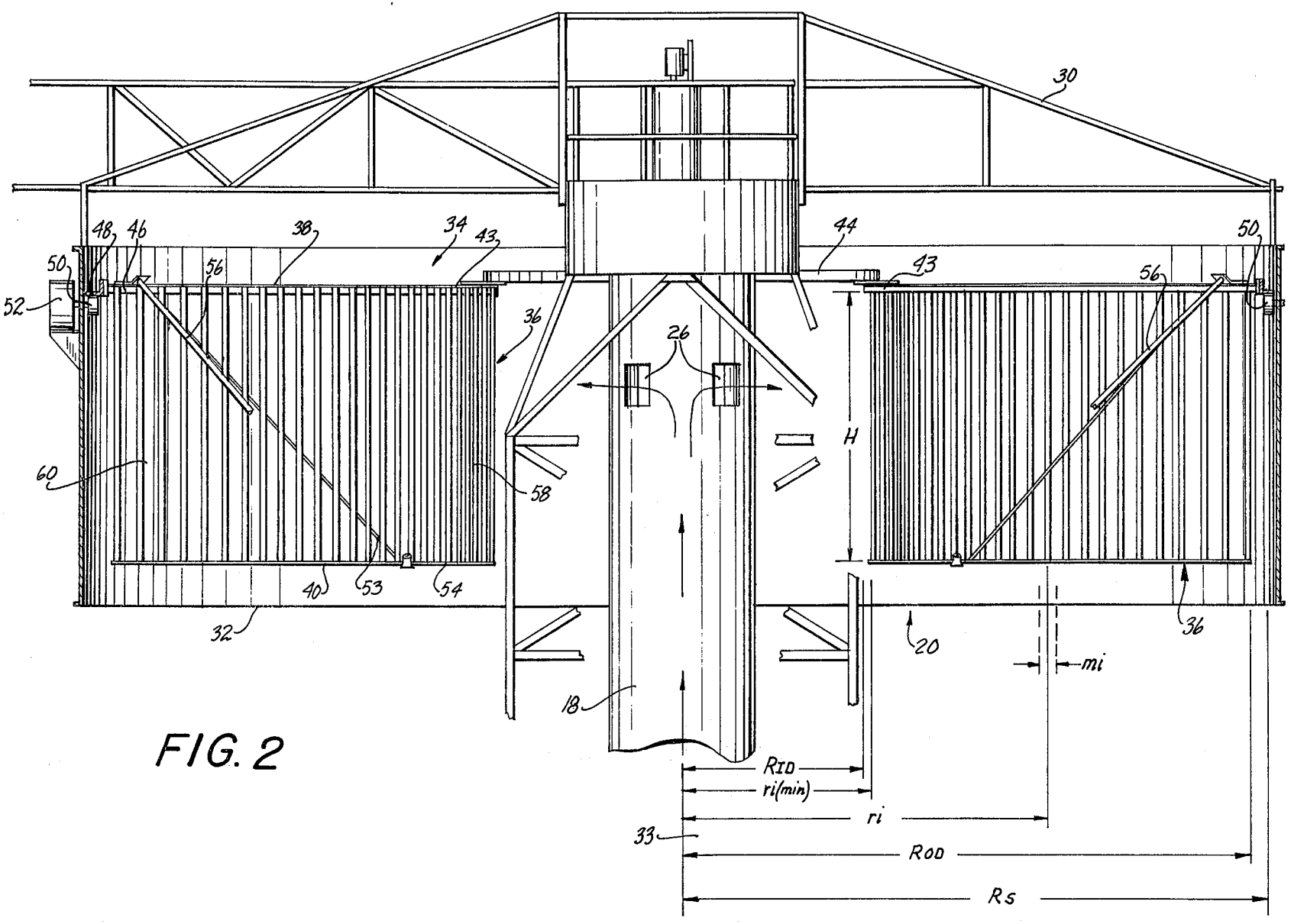
FIG. 2 is a vertical sectional view of the flocculating chamber shown in FIG. 1.

As best shown in FIG. 2, the flocculator 20 includes a superstructure 30 which is mounted on the top of the column 18. A cylindrical shell 32 is supported from the superstructure 30 in concentric relationship with respect to the column 18 and defines a flocculating chamber having a central axis which is coaxial with the vertical axis 33 of the column 18. The flocculator 20 also includes an agitator or paddle wheel mechanism 34 including one or more paddles or rotor elements generally indicated at 36. In one embodiment of the invention six paddles are provided. As shown, each of the paddles 36 is in the form of a screen or grating and includes an upper paddle arm 38, a lower paddle arm 40, and a plurality of pale elements 42 secured to and between the arms 38 and 40. The inner end 43 of each upper arm 38 of each paddle 36 is interconnected by a framework 44 which encircles the column 18. The outer end 46 of each upper arm 38 of each paddle 36 is secured to a ring 48 which is supported on and driven by two rollers indicated at 50. The ring 48 is also supported by four idler rollers (not shown). Preferably, each of the rollers 50 is driven by a suitable electric motor, one of which is shown at 52, to rotate the agitator 34 about the vertical axis 33 at a predetermined rotational speed.

Each of the paddles 36 includes a strengthening rod or tie-bar 53 which extends from the outer end 46 of the upper arm 38 to a point near the inner end 54 of the lower arm 40 and is secured to the arms 38 and 40. Also, the outer end 46 of the upper arm 38 is connected on opposite sides by two rods 56, to the inner end 54 of each of the lower arms 40 of the adjacent paddles 36. The rods 56 maintain the pale elements 42 of the paddle 36 in a generally upright or vertical position.

Figures 3, 4:
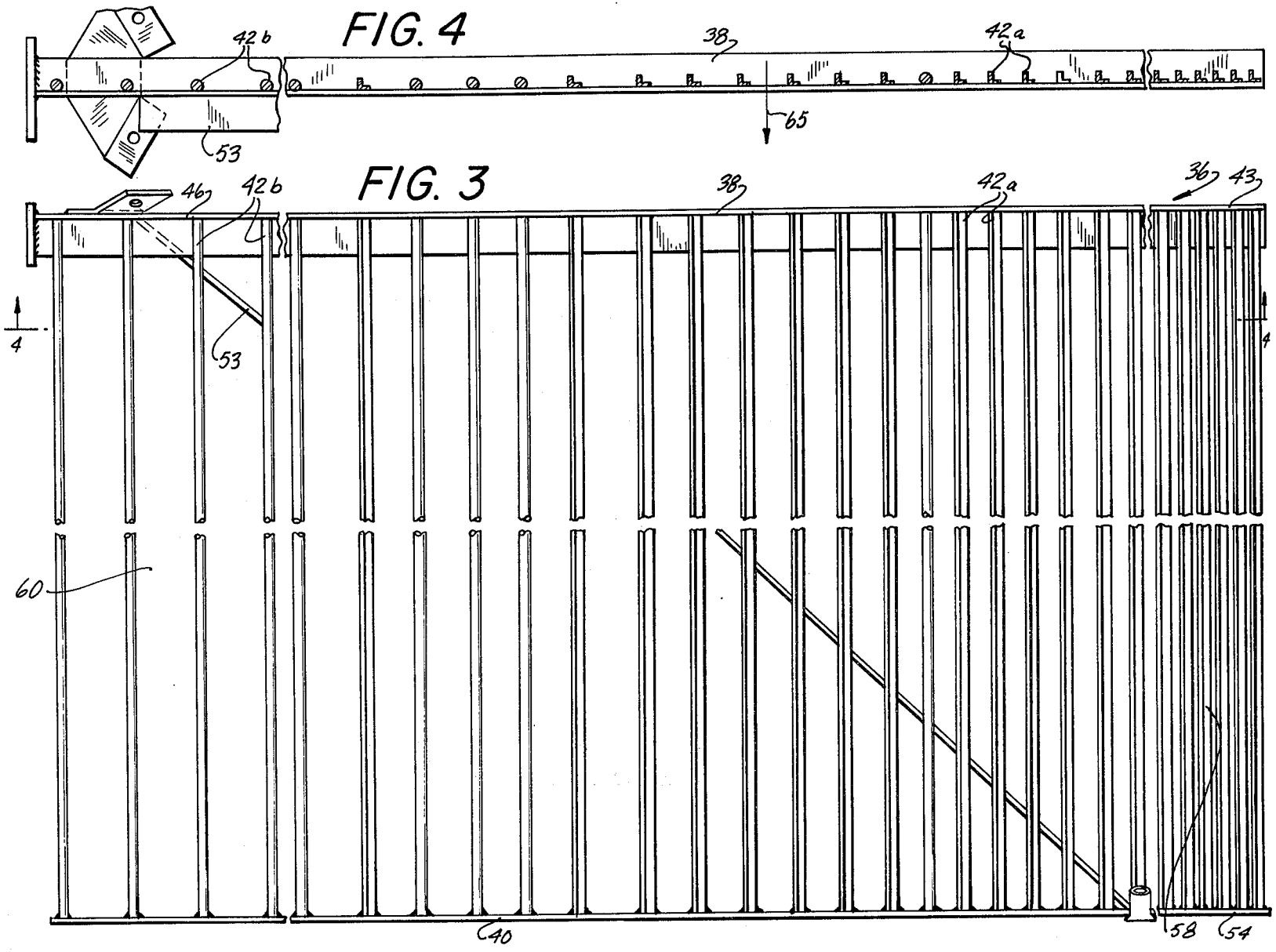
FIG. 3 is a side elevation of one of the flocculator paddles shown in FIG. 2.
FIG. 4 is a sectional view taken along line 4—4 of FIG. 3.

In accordance with the teachings of the present invention, the pale elements 42 have a predetermined projected area, size, shape and disposition so that when the paddles 36 are rotated at any rotational speed through a body of liquid having any viscosity the paddle will produce or establish a uniform velocity gradient, G, in the agitated portion of the body of liquid. To accomplish this result, the pale elements 42 at the inner end 58 of the paddle 36 are more closely spaced than the pale elements 42 at the outer end 60 of the paddle 36. Also, as shown in FIG. 4, some of the pale elements **42*a* have an L-shaped cross section whereas other of the pale elements 42*b* have a circular cross section. Pale elements 42*a* and 42*b* having these cross sections are used in the illustrated embodiment because they are readily available commercially and it will be understood, that pale elements 42** having other cross sections can be utilized depending on the drag coefficient, D, of the pale element, as it is moved through a given liquid.

The agitation or velocity gradient produced by one of the pale elements 42, as it moves through a liquid having a predetermined visocsity, density and temperature, is determined by the linear velocity of the pale element (rotational speed times radial distance of the element from the axis of rotation), the size (width) of the pale element, the shape (drag coefficient) of the pale element, and the ratio of the projected area (width × height) of the pale element to a radial increment of the paddle including that pale element. Thus, by varying the size (width), shape(drag coefficient), and the disposition (spacing between elements) of each pale element it is found that a paddle can be constructed which will produce a uniform velocity gradient in a body of liquid when the paddle is rotated through the liquid at a predetermined rotational speed.

The required relation of these parameters to achieve a uniform velocity gradient can be shown by noting that:

$$G = K_1 \sqrt{HP/V}$$

$$HP = K_2 Cd\, r^4 f^4$$

$$V = K_3 r^2$$

where $G$ = velocity gradient
$HP$ = energy exchange rate
$v$ = volume
$Cd$ = drag coefficient; i.e., shape factor
$r$ = radius; i.e., distance of paling element from axis
$f$ = fraction of the radial increment covered by the paling element or its projection. (f is numerically equal to 1/centerline to centerline spacing between elements expressed in element widths)
$K_1$, $K_2$, $K_3$ = constants or variables independent of radial distance.

Thus in order to hold G uniform along a radius it is necessary and sufficient that $HP/V$ be constant and thus $Cd\ r^4 f^4/r^2$ must be a constant. This condition requires that $\sqrt{Cd} \times f^2$ vary as $1/r$.

The condition $\sqrt{Cd} \times f^2$ varies as $1/r$ inches is the design criteria for a uniform velocity gradient agitator paddle.

In practice, this condition is expressed as $$" Cd \left(\frac{W}{W/f}\right)^2$$

varies as $1/r$ inches and can be easily met by manipulation of three variables — the shape of the paling ($Cd$), the width of the paling ($W$) and the spacing of the adjacent palings ($1/f \times w$).

The shape factor can be selected from a narrow range in large, irregular, fixed increments. ($Cd$ = 1.2 for cylindrical palings; 2.0 for angle shaped elements oriented for maximum resistance.) The width ($W$) can be selected from a very broad range of commercially available material (pipe-rods-angles, etc.) in small, fixed, more or less regular increments for any desired shape factor. The spacing ($W/f$) can be sleected from an infinite range.

In the simplest form conceptually, the relation $$" \overline{Cd} \times \left(\frac{W}{W/f}\right)^2$$

varies as $1/r$ inches can be satisfied by manipulation of only one of the variables $Cd$, $W$, or $W/f$. For example: using paling elements of same size, shape, and orientation (i.e., where both $W$ and Cd are constant), the required relation reduces to $f^2$ varies as $1/r$).

In actual practice, especially practical for small structures, a paddle structure can be made from a standard, commercially available grating or fencing material consisting of parallel, round, equally spaced and sized bars attached to low profile support members perpendicular to bars. The paddle is mounted so that the long dimension of the bars are parallel to the axis of rotation. The grating is formed into a curved paddle so that the projection of spacing the bars onto a raduis is not uniform.

In a curved grating the projection of a round element on a radius has the same width as in the grating, the projection of the space between elements is, however, foreshortened so that the length of the space W/f becomes $$\frac{W}{f_o\ R/L}$$

where L is the length (straight) of the grating sweeping an annular increment and R is the radial width of the increment and $W/f_o$ is the spacing of the straight grating. That is, L varies as f and the curve must satisgy the relation "$L^2$ varies as $1/R$".

It can be shown that this realtion defines a curve described in polar coordinates as $$O = \frac{2}{r_o} \sqrt{\frac{r_o - r}{r}}$$

where $r_o$ is the outer radius of the agitator paddle. This curve can be developed graphically as shown in FIG. 5 by dividing the radisu of the circle swept by the paddles into 10 equal portions and scribing concentric circles forming equal width annuli. Assume the length of the frating sweeping outermost annulus to be equal to the width of the annulus (i.e., that the outermost end of the paddle is straight and lies upon a radius). The length of the grating sweeping the inner annuli is tabulated below:

| Increment of Radius in Annulus | Length of Grating Sweeping Annulus |
|---|---|
| 1.0 – .9 | 0.100 $r_o$ |
| .9 – .8 | 0.105 $r_o$ |
| .8 – .7 | 0.112 $r_o$ |
| .7 – .6 | 0.120 $r_o$ |
| .6 – .5 | 0.136 $r_o$ |
| .5 – .4 | 0.142 $r_o$ |
| .4 – .3 | 0.158 $r_o$ |
| .3 – .2 | 0.182 $r_o$ |

The actual velocity gradient produced can be determined by the equation $$G^2 = 2.1\ (\rho/g)\ N\ (rpm)^3\ Cd\ r_o^2\ f_o^4$$

$$\text{where } (\rho/g) = \frac{\text{Liquid density in force units (1.93 lb–sec for water at 50°F)}}{\text{lb}^4}$$

= absolute viscosity of liquid in centiposie (1.0 for water 50° F)
$N$ = number of paddles
$Cd$ = Drag coefficient-dimensionaless (1.2 for round bars)

It is to be understood that a uniform velocity gradient can be obtained with other configurations in addition to the paddle embodiments described above. For example, referring to FIG. 5, it has been found that a paddle fabricated of evenly spaced, pale elements 68 having the same size and shape can be arranged along a curve to yeild the required projected profile to provide a uniform velocity gradient as the paddle moves through a body of liguid. Although the pale elements 68 have the same size and shape and the same spacing between pale elements, the radial distance between elements is not uniform to produce the substantially uniform velocity gradient desired. The disposition of the pale elements 68 when laid out on a radius 70 is shown in FIG. 6.

With reference to FIG. 7, another embodiment incorporating the features of the instant invention is shown wherein a plurality of paddles 80, 82 are disposed so that their pale elements 81, 83, respectively, are interposed between each other, as shown. In such arrangement, one paddle may be rotated while the other is stationary, or, both paddles may be rotated, either in the same direction, or, in opposing directions. It is known that the energy dissipated by a moving pale element is a function of the power of its speed of rotation relative to the liquid. As exemplified in FIGS. 1 – 6, only the moving pale elements are shown on a single paddle configuration. However, in practice, stationary or counter rotating pale elements might be interposed between the first mentioned pale elements. Such stationary or counter rotating pale elements reduce the tendency of the body of liquid to assume a rotation and thus reduce the relative speed of the first mentioned moving pale elements to the liquid. Such stationary or counter rotating outer elements are usually located on the outer portion of the paddle radius where they are most effective and may be of uniform or non-uniform size, shape, and spaced to avoid conflict with the pale elements of the other paddle.

Although the present invention has been described with particular reference to its use in a flocculator 20, it is to be understood that the agitator 34 can be used in other applications where it is desirable to uniformly agitate a fluid by producing a uniform velocity gradient in the fluid.

I claim:

1. A liquid agitator of the type having at lease one paddle mounted for rotation about an axis in a fluid receiving chamber, said paddle having a paddle area which extends radially from said axis, said paddle area being divisible into radial increments, each increment generating an annular volume when said paddle is rotated about said axis, said paddle including at least one pale element in each radial increment, each said pale elements having a predetermined size, shape and disposition for dissipating kinetic energy in a liquid when said paddle is rotated through said liquid whereby the energy dissipated per unit volume of liquid in said annular volumes through which each of said pale elements of said paddle travels is substantially the same.

2. A liquid agitator as defined in claim 1 further including a second paddle, said second paddle having a plurality of pale elements interposed between said pale elements of the rotating paddle.

3. A liquid agitator ad defined in claim 2 wherein said second paddle and pale elements are stationary.

4. A liquid agitator as defined in claim 3 wherein said second paddle and pale elements are rotated relative to the other rotating paddle.

5. In a liquid agitator of the type having at least one paddle mounted for rotation about an axis, the improvement comprising a paddle construction wherein each paddle includes radially extending support means, a plurality of spaced pale elements secured to said support means, each of said pale elements having a predetermined size and shape and being spaced a predetermined distance from adjacent pale elements whereby said paddle produces a uniform velocity gradient in a liquid when said paddle is rotated through said liquid.

6. The liquid agitator as defined in claim 5 wherein some of said pale elements have a circular cross section.

7. The liquid agitator as defined in claim 5 wherein some of said pale elements have an L-shaped cross section.

8. The liquid agitator as defined in claim 7 wherein each of said L-shaped pale elements has first and second flange portions forming said L, said first flange portion having an outer surface which lies in a radial plane extending from said axis and second flange portion having an outer surface which lies in a plane which is tangent to the radial plane.

9. The liguid agitator as defined in claim 5 wherein said pale elements on said paddle are more closely spaced near said axis than those positioned away from said axis.

10. The liquid agitator as defined in claim 9 wherein said pale elements adjacent said axis have an Lshaped cross section.

11. The liquid agitator as defined in claim 8 wherein said pale elements positioned away from said axis have a circular cross section.

* * * * *